US008973509B2

(12) United States Patent
Hédé

(10) Patent No.: US 8,973,509 B2
(45) Date of Patent: Mar. 10, 2015

(54) METHOD FOR MANUFACTURING A STRAP RING FOR CLIMBING ACTIVITIES, FROM A TUBULAR FABRIC AXIALLY CUT UP

(75) Inventor: Jean-Marc Hédé, Domène (FR)

(73) Assignee: Zedel, Crolles (FR)

( * ) Notice: Subject to any disclaimer, the term of this patent is extended or adjusted under 35 U.S.C. 154(b) by 42 days.

(21) Appl. No.: 13/550,107

(22) Filed: Jul. 16, 2012

(65) Prior Publication Data

US 2013/0061429 A1 Mar. 14, 2013

(30) Foreign Application Priority Data

Sep. 12, 2011 (FR) ..... 11 02768

(51) Int. Cl.
*B65D 63/10* (2006.01)
*A63B 29/02* (2006.01)

(52) U.S. Cl.
CPC ..... *A63B 29/02* (2013.01)
USPC ..... 112/475.01; 294/74

(58) Field of Classification Search
CPC ..... A63B 29/00; A63B 29/02; A44B 11/00; A44F 5/00; B66C 1/18
USPC ..... 24/298–302; 112/475.01, 475.06, 112/475.08, 308; 294/74
See application file for complete search history.

(56) References Cited

U.S. PATENT DOCUMENTS

| | | | | |
|---|---|---|---|---|
| 1,757,958 | A * | 5/1930 | Goldwyn | 112/475.08 |
| 2,066,545 | A * | 1/1937 | Shuttleworth | 428/88 |
| 2,217,517 | A * | 10/1940 | Lances | 2/338 |
| RE26,515 | E * | 1/1969 | Holliday | 604/370 |
| 3,592,502 | A * | 7/1971 | Bolliger | 294/74 |
| 3,776,585 | A * | 12/1973 | Bridgehouse | 294/74 |
| 4,025,100 | A * | 5/1977 | Bridgehouse | 294/74 |
| 4,209,044 | A * | 6/1980 | Taki | 139/411 |
| 4,289,820 | A * | 9/1981 | Blessing | 428/125 |
| 4,500,578 | A * | 2/1985 | van de Kamp | 428/36.1 |
| 4,856,837 | A * | 8/1989 | Hammersla, Jr. | 294/74 |
| 5,498,047 | A * | 3/1996 | Treuling | 294/74 |
| 6,149,215 | A * | 11/2000 | Balogh et al. | 294/74 |
| 6,331,024 | B1 * | 12/2001 | Gulley | 294/74 |
| 6,443,668 | B1 * | 9/2002 | Streuer et al. | 405/302.7 |
| 6,581,726 | B1 * | 6/2003 | Petzl et al. | 182/7 |
| 6,705,244 | B1 * | 3/2004 | Berger et al. | 112/475.06 |
| 6,994,724 | B2 * | 2/2006 | Schmitt | 623/1.51 |
| 7,357,433 | B2 * | 4/2008 | Hess et al. | 294/74 |
| 7,641,834 | B2 * | 1/2010 | Weimer | 264/258 |
| 7,927,179 | B2 * | 4/2011 | Kaye | 450/86 |

(Continued)

FOREIGN PATENT DOCUMENTS

| | | |
|---|---|---|
| EP | 0 345 176 A1 | 12/1989 |
| FR | 2 632 195 A1 | 12/1989 |

(Continued)

*Primary Examiner* — Victor Batson
*Assistant Examiner* — David Upchurch
(74) *Attorney, Agent, or Firm* — Oliff PLC

(57) ABSTRACT

A method for manufacturing a strap ring (1), made from a material woven with warp threads (3) and at least one weft thread (4) extending between the warp threads (3). The woven material is a tubular fabric (11) whose warp threads (3) extend parallel to the axis of extension of the tubular fabric (11), the strap ring (1) being made from an axial section (16) of the tubular fabric (11) which is axially cut up by cutting the warp threads (3).

3 Claims, 2 Drawing Sheets

(56) References Cited

U.S. PATENT DOCUMENTS

| | | | | |
|---|---|---|---|---|
| 2003/0101944 | A1* | 6/2003 | Heinrichs | 119/770 |
| 2005/0093317 | A1* | 5/2005 | Hess | 294/68.3 |
| 2008/0007077 | A1 | 1/2008 | Petiot et al. | |
| 2008/0032599 | A1* | 2/2008 | Kaye | 450/86 |
| 2010/0282359 | A1* | 11/2010 | Rabin et al. | 139/396 |
| 2010/0314922 | A1* | 12/2010 | Poulakis | 297/218.2 |

FOREIGN PATENT DOCUMENTS

| | | | |
|---|---|---|---|
| FR | 2 857 879 | A1 | 1/2005 |
| FR | 2 870 686 | A1 | 12/2005 |
| FR | 2 881 035 | A1 | 7/2006 |
| KR | 10-2011-0096665 | | 8/2011 |
| WO | WO 2010/009360 | A2 | 1/2010 |

* cited by examiner

METHOD FOR MANUFACTURING A STRAP RING FOR CLIMBING ACTIVITIES, FROM A TUBULAR FABRIC AXIALLY CUT UP

TECHNICAL FIELD OF THE INVENTION

The present invention is used in the field of equipment for climbing activities, such as climbing sports or similar activities. More specifically, the present invention concerns strap rings formed from a fabric closed as a loop on itself, and used as a fastening body between two elements to be joined together.

STATE OF THE ART

In the field of equipment for climbing or similar activities, strap rings are known which are used to join two elements together. For example, strap rings are used to form a quickdraw, by connecting together remotely fastening bodies such as metal rings, carabiners or similar fastening bodies. For example, strap rings are still used to connect together constitutive parts of a harness or similar, such as a sit harness and leg loops. Strap rings are still used for example to form a fixing body for such a harness, for anchoring various climbing equipment accessories. As an example, one can refer to the documents FR2632195 (PETZL) or FR2857879 (SNAP), which describe various applications of such strap rings.

Strap rings are usually made from a material woven from synthetic threads, containing polyamide or polyethylene, or polyester in particular, and must provide a mechanical resistance adapted to their protected use for climbing activities. Strap rings are traditionally obtained from a woven material band which is closed as a loop on itself, and whose ends are fixed together, by sewing or making a knot or via a connecting body for example. One can refer for example to the documents FR2881035 (ZEDEL), FR2870686 (TECHNI SANGLES) which describe such strap rings.

Traditionally, bands from which strap rings are made stem from a blank formed by warp and weft weaving. A warp comprises a set of warp threads which are arranged parallel to one another, and which provide a support for at least one weft thread running between warp threads. In order to obtain a band, the blank is cut out so that the warp threads are oriented in the lengthwise direction of the band. As the band is closed as a loop on itself by fixing its longitudinal ends together, the warp threads provide for the strap ring a resistance to the traction to which it is intended to be subjected.

Such methods for manufacturing a strap ring are worth improving, in order to make it at a lower cost and to optimize the fatigue and rupture strength thereof.

OBJECT OF THE INVENTION

The present invention aims at proposing a method for manufacturing a strap ring from a woven material, which allows to make the strap ring at a lower cost while optimizing the fatigue and rupture strength thereof, for a given structure of warp threads and weft threads.

The present invention also aims at proposing a strap ring obtained from the implementation of the method according to the present invention, which optimizes a fatigue and rupture strength for a given structure of the threads forming the fabric from which it is made.

The present invention also proposes to take advantage of the properties of fatigue and wear strength of such a strap ring, for forming various climbing equipment accessories, such as a harness and a quickdraw.

The method according to the present invention is a method for manufacturing a climbing equipment accessory made up of a strap ring. The strap ring is made from a material woven with warp threads and at least one weft thread which extends between the warp threads.

According to the present invention, the method for manufacturing such a strap ring is mainly recognizable in that the woven material is a tubular fabric whose warp threads extend parallel to the axis of extension of the tubular fabric. The strap ring is made from an axial section of the tubular fabric, which is obtained by axially cutting up the warp threads. The axial section cut up from the tubular fabric has the shape of a loop without any attached fixing means specifically for maintaining its loop conformation, and side hems are preferentially obtained by folding down the end faces of the section.

More specifically, the manufacturing method includes the following operations:

weaving a tubular fabric with warp threads and at least one weft thread, the warp threads extending parallel to the axis of extension of the tubular fabric and the at least one weft thread spirally extending between the warp threads, cutting up axial sections of the tubular fabric by cutting the warp threads, each section forming a loop from which a respective strap ring is formed.

Preferably, the method includes an additional operation for forming side hems with at least one return, by laterally folding down and circumferentially sewing the hems to the peripheral wall of the section.

The resistance of the strap ring to radial tensile efforts is obtained by means of the weft thread which spirally extends in a continuous way between the warp threads from one side edge of the loop to another. For a given structure of a weft thread, the strap ring is robust, the tensile loads are stood by all of the successive turns of the weft thread. The structural characteristics of the weft thread are to be considered in particular by taking into consideration its section, its number of strands and/or the material it is made of.

The closed-loop conformation of the strap ring is obtained by the operation consisting in axially cutting up the tubular fabric without any assembling operations, such as a sewing operation or similar. The axial cutting-up operation for the tubular fabric can be easily carried out at high rates and at a low cost, indifferently at the exit of a weaving station for the tubular fabric or in a specialized workshop specifically dedicated to this axial cutting-up operation. The axial extension of each section determines the width of the loop obtained, which determines the width of the strap ring. The axial cutting-up of the tubular fabric can be easily carried out along various axial extensions of each section according to the needs, by avoiding tiresome operations of adjusting the cutting machine used to extract the strap ring from the tubular fabric.

The side edges of the section are preferably hemmed, in order to protect the free ends of the laterally emerging of flushing warp threads, and to increase the total thickness of the strap ring obtained. The hems are in particular carried out at the side edges of the section, by folding down with at least one return the fabric towards the interior of the section according to the orientation of extension of the warp threads. The hems are fixed by circumferentially sewing the hems to the peripheral wall of the section. Other similar means of fixing the hems to the peripheral wall of the section can be used.

According to one embodiment, the diameter of the zones of the tubular fabric, and of the section it is made from, corresponding to the returns formed by said folds, is lower than the peripheral diameter of the tubular fabric corresponding to the external face of the peripheral wall of the section. Such arrangements make it possible to avoid an imbalance between the tensions to which the weft thread is subjected in the various zones corresponding respectively to the return formed by the fold and to the external face of the peripheral wall of the strap ring obtained. The differences in diameter of the tubular fabric, for each zone corresponding to the returns, corresponds in particular to a reduction of about the double of the diameter of the weft thread.

Each fold has for example two successive returns, including one covering return for an end return. The zones of the section, and of the tubular fabric it is made from, corresponding to the covering returns, have a diameter lower than the diameter of the zones of the section, and of the tubular fabric it is made from, corresponding to the end returns, which have a diameter lower than the peripheral diameter of the tubular fabric.

According to a particular embodiment according to which the strap ring is used to form a quickdraw, the section is flattened and transversely sewn, by forming a median flat surface of the strap ring bordered by end eyelets. The concept of transverse seam is to be considered as extending between the two side edges of the strap ring, such as substantially along the orientation of extension of the warp threads, even with an important slope of the seams relative to this orientation.

The strap ring which is obtained from the implementation of the method of the invention as described, is arranged in a loop closed on itself. The loop forming the peripheral wall of the strap ring has no assembling means specifically for maintaining the closed-loop conformation, in particular no attached assembling means such as seams for example.

As the loop is made from a material woven with warp threads and at least one weft thread, one will recognize in particular a strap ring according to the present invention in that the warp threads are oriented along the axial extension of the loop, and in that the weft thread spirally extends in a continuous way between the warp threads, from one side edge of the peripheral wall of the strap ring to another.

The peripheral wall of the strap ring is preferably lined with interior hems having at least one return, which are respectively carried out by folding down the side edges of the peripheral wall of the strap ring. According to a preferred embodiment, each hem comprises two supposed returns assembled, in particular by sewing, to the peripheral wall of the strap ring.

According to a preferred embodiment, at least the weft thread, if not also the warp thread, are made from a synthetic material containing polyethylene or another similar material that can provide a strong fatigue and tensile strength. The material used the weft thread is made of is preferably a robust synthetic material, in particular containing polyethylene. As the warp threads form only a support for the weft thread, the warp threads can be made from a less robust synthetic material, such as a polyamide material.

According to a general structure of the threads forming the strap ring, any one of the warp threads and the weft thread is indifferently a monostranded thread or a multistranded thread. The weft thread can be a monostranded thread, or advantageously a multistranded thread in order to increase its resistance for a given section. As the warp threads form only a support for the weft thread, their monostranded thread structure can be used. Potentially, the warp threads can also be multistranded threads.

A strap ring according to the present invention as described can be applied to many climbing equipments and accessories. For example, a harness according to the present invention can integrate one or more strap rings as described. A strap ring according to the present invention can connect together constitutive parts of the harness, such as a sit harness with leg loops, and/or an body for anchoring a climbing equipment accessory to the harness.

In another example, a quickdraw according to the present invention can integrate one or more strap rings as described. A strap ring according to the present invention comprising one said median flat surface bordered by end eyelets can form a link between at least two fastening bodies, such as metal rings and/or carabiners for example.

DESCRIPTION OF THE FIGURES

Embodiment examples of the present invention will be described in relation to the annexed Figures, in which:

In FIG. 1 and FIG. 2, a climbing equipment accessory consists of a strap ring 1 in the form of a loop closed on itself. The strap ring 1 is made from a fabric with warp threads 3 and at least one weft thread 4. The warp threads 3 extend along an orientation corresponding to the axial orientation A of the strap ring 1. The weft thread 4 spirally extends from one side edge of the strap ring 1 to another.

Figure 3:
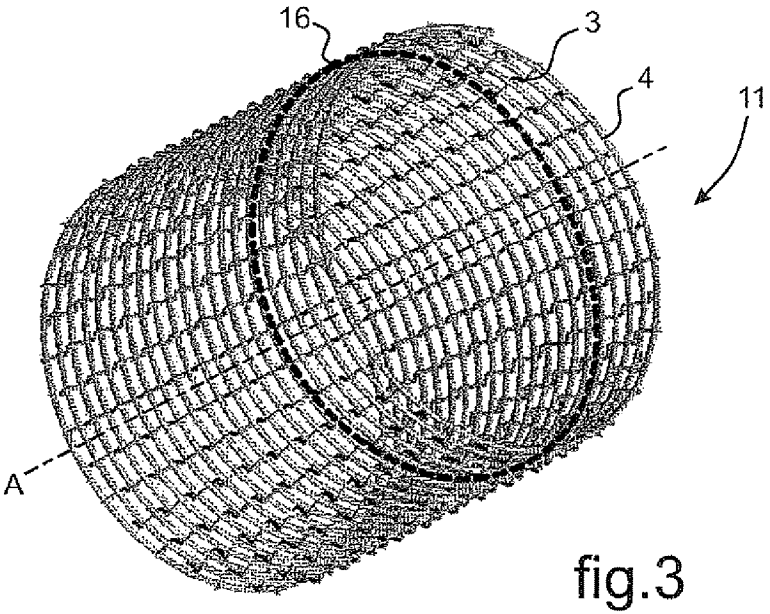
FIG. 3 is a perspective illustration of a tubular fabric from which a fabric section is cut up and used to form a strap ring as represented in FIG. 1 and FIG. 2.

The strap ring 1 comprises side hems 5, 6, which are formed by laterally folding down some fabric with two returns 7, 8 towards the interior of the strap ring, along the extension of the warp threads 3 of the strap ring 1. One of the returns is a end return 8 and another return is a covering return 7 for the end return 8. Each of the side hems 5, 6 is fixed to the peripheral wall 2 of the strap ring 1, by means of circumferential seams 9, 10.

Figure 1:
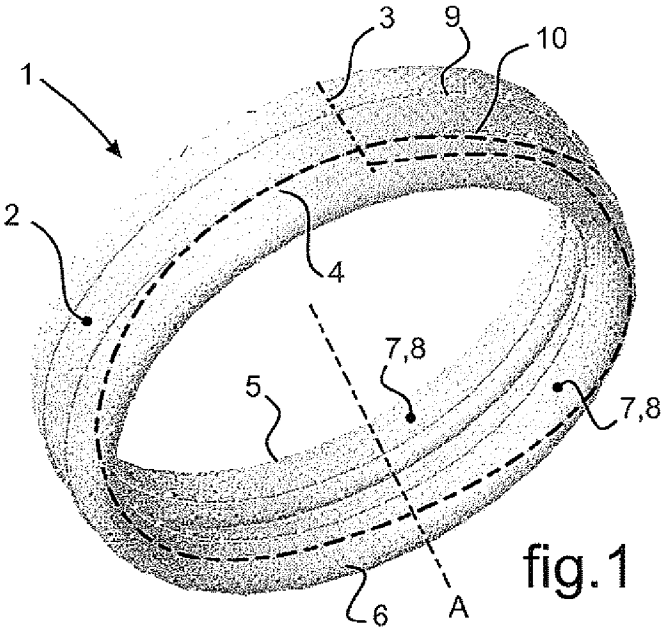
FIG. 1 and FIG. 2 are illustrations of a strap ring according to an embodiment example of the present invention, represented respectively in perspective and sectional views.
Figure 2:
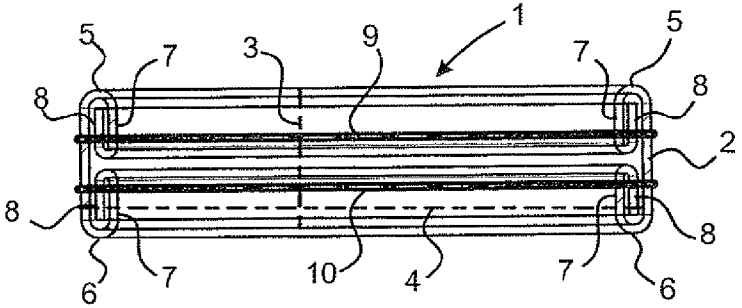

In FIG. 3, the strap ring represented in FIG. 1 and FIG. 2 is made from a tubular fabric 11, which is axially cut up in a plurality of sections 16 strap rings are respectively formed from. The tubular fabric 11 comprises warp threads 3 which are oriented in parallel along the axial extension A of the tubular fabric 11, and one weft thread 4 which is spirally rolled up on the periphery of the tubular fabric 11 while extending between the warp threads 3. The section 16 the strap ring is formed from is cut up from the tubular fabric 11 by cutting the warp threads 3 along an axial extension corresponding to the width of the strap ring to be obtained, increased by the fabric width necessary for forming the side hems.

The tubular fabric 11 represented in FIG. 3 has a constant diameter. It is however preferred to have a tubular fabric 11 with a varying diameter, as represented in FIG. 4.

Figure 4:
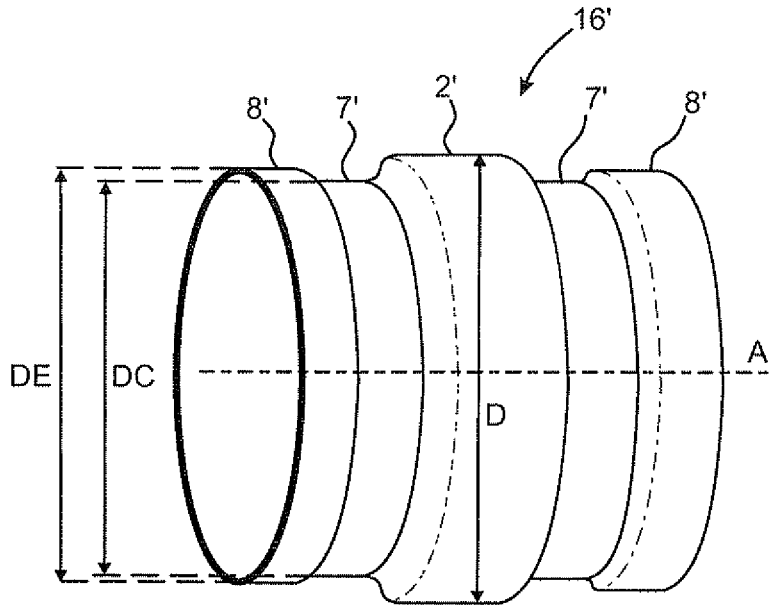
FIG. 4 is a perspective illustration of a tubular fabric section a strap ring is formed from as represented in FIG. 1 and FIG. 2, according to a preferred embodiment.

In FIG. 4, a section 16' is made from a tubular fabric with warp threads and at least one weft thread as represented in FIG. 3. The section 16' comprises zones 8', 7', 2' with various diameters DE, DC, D which makes it possible to hem the side edges of the strap ring while avoiding differences in tension in the weft thread when the formation of the hems is completed. Such differences in tension can be induced by successively folding down the various hem returns. End zones 8' of the section 16' correspond to a respective end return, and have a diameter DE higher than the diameter DC of intermediate zones 7' of the section 16', and lower than the diameter D of a median zone 2' of the section 16'. The intermediate zones 7' correspond to zones of the section 16' forming covering returns. The median zone 2' corresponds to a zone of the section 16' forming the external face of the peripheral wall of the strap ring.

The axial extension of the median zone 2' corresponds to the axial extension of each group of zones 7', 8' including an end zone 8' increased by the intermediate zone 7' which is interposed between this end zone 8' and the median zone 2. Once the formation of the hems (5, 6 in FIG. 1 and FIG. 2) is completed, the thickness of the strap ring obtained corresponds to the triple of the thickness of the section 16' the strap ring is made from, as it can be seen particularly in FIG. 2.

Figure 5:
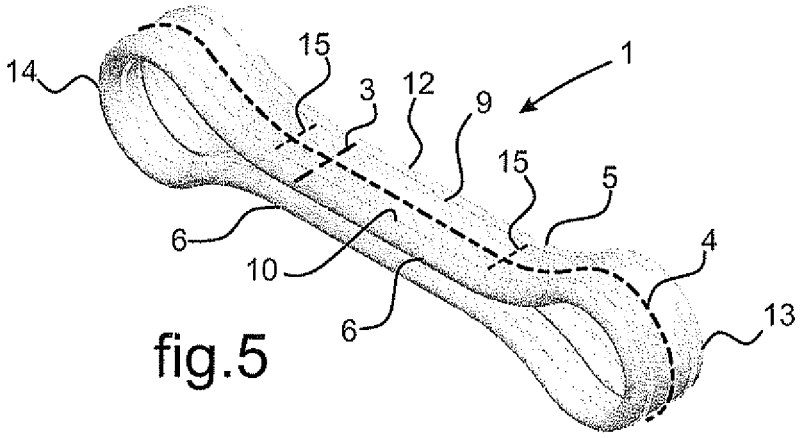
FIG. 5 is a perspective illustration of a quickdraw link formed from a strap ring represented in FIG. 1 and FIG. 2.

In FIG. 5, the strap ring of 1 represented in FIG. 1 and FIG. 2 is flattened in the median zone to form a median flat surface 12 by superposition of two opposite parts of the strap ring. The median flat surface 12 is bordered by two end eyelets 13, 14 which are intended to receive fastening bodies, such as rings or carabiners, in order to form a quickdraw. The conformation of the median flat surface 12 is maintained by transverse seams 15, which extend between the side edges of the strap ring, parallel to the warp threads 3.

The invention claimed is:

1. Method for manufacturing a climbing equipment accessory made up of a strap ring made from a woven material with warp threads and at least one weft thread extending between the warp threads, the woven material comprising a tubular fabric, the method comprising:

weaving the tubular fabric with warp threads extending parallel to an axis of extension of the tubular fabric;

cutting up axial sections of the tubular fabric by cutting the warp threads, each axial section forming a loop from which a respective strap ring is formed;

hemming the two side edges of each axial section by folding down, with at least one return, the fabric towards an interior of the respective axial section along an orientation of extension of the warp threads, so as to form two opposite hems; and sewing circumferentially the two opposite hems to a peripheral wall of the respective axial section.

2. Method according to claim 1, wherein a diameter (DE, DC) of zones of the tubular fabric corresponding to the at least one return formed by the folding down, is lower than a peripheral diameter (D) of the tubular fabric corresponding to an external face of the peripheral wall of the respective axial section.

3. Method according to claim 1, wherein the at least one axial section is flattened and transversely sewn by forming a median flat surface of the strap ring bordered by end eyelets.

* * * * *